US006454581B1

(12) United States Patent
Ribeiro

(10) Patent No.: US 6,454,581 B1
(45) Date of Patent: Sep. 24, 2002

(54) PLUG FOR COVERING A PLURALITY OF OPENINGS OF AN ELECTRONIC DEVICE

(75) Inventor: Durval S. Ribeiro, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/750,564

(22) Filed: Dec. 28, 2000

(51) Int. Cl.[7] ..... H01R 13/44
(52) U.S. Cl. ..... 439/148; 439/135
(58) Field of Search ..... 439/148, 135, 439/923, 676, 133, 142, 489

(56) References Cited

U.S. PATENT DOCUMENTS 5,199,888 A 4/1993 Condra et al. ..... 439/142
5,480,312 A * 1/1996 Watanabe et al. ..... 439/148
5,507,657 A * 4/1996 Seto et al. ..... 439/135
5,527,186 A * 6/1996 Ito et al. ..... 439/148
5,601,349 A 2/1997 Holt ..... 312/265.6
5,605,467 A * 2/1997 Beck et al. ..... 439/148
5,637,002 A * 6/1997 Buck et al. ..... 439/148
5,640,309 A 6/1997 Carney et al. ..... 361/801
5,748,453 A 5/1998 Carney et al. ..... 361/801
5,899,760 A * 5/1999 Ho et al. ..... 439/135

* cited by examiner

*Primary Examiner*—Neil Abrams
*Assistant Examiner*—J. F. Duverne
(74) *Attorney, Agent, or Firm*—Baker & Hostetler LLP

(57) ABSTRACT

A plug for covering an opening of an electronic device includes at least two elongated members and at least one tab. The elongated members are sized and positioned to substantially fill or cover two or more openings of an electronic device. Preferably, the plug also includes two gripping wings to facilitate insertion of the plug into the openings and removal of the plug from the openings.

20 Claims, 3 Drawing Sheets

PLUG FOR COVERING A PLURALITY OF OPENINGS OF AN ELECTRONIC DEVICE

FIELD OF THE INVENTION

The present invention generally relates to covers and plugs associated with electronic devices. More particularly, the present invention relates to a plug or cover for a plurality of openings in an electronic device, such as card openings or disk drive openings, to help prevent or minimize the likelihood that contaminants will enter into the electronic device through the openings.

BACKGROUND OF THE INVENTION

Electronic devices, such as personal computers, portable computers, diagnostic equipment or analyzers, testing devices, electronic games, remote controls, pocket computers, palms, and other devices are often manufactured such that the housing of the device includes one or more ports or openings that allow for the insertion of items into the device. Such an opening may be, for example, a floppy disk or CD ROM drive opening. Alternatively, the opening may be for the insertion of an expansion card, a modem card, a memory card, or any type of card or other device which may add functionality to the device and/or allow for a removable storage medium for data collected and/or used by the device. When a card, disc, or other item is not inserted into such a port or opening, the opening typically provides an area through which undesired contaminants, such as dust, dirt, or liquids, may enter into the device and damage the device. This potential for contamination is a particular problem in industrial and maintenance environments, such as automobile repair shops, where dirt, grease, and oil are present and may frequently come into contact with the electronic device.

Prior art attempts to prevent contaminants from entering into electronic device ports include devices such as that disclosed in U.S. Pat. No. 5,640,309, to Carney et al., which discloses an expansion card that includes a cover which blocks the opening after the card has been plugged in. A retainer clip is mounted on the device so that, when in operative position, the retainer is attached to the cover and engages the cover to assist holding the card in place. Similarly, U.S. Pat. No. 5,748,453, to Carney et al., discloses a blanking cover that covers a card opening when a card is not inserted into the opening. The blanking cover is held into place by a tongue receptor and a retainer track affixed to the housing of the electronic device.

Another example of a prior electronic device port cover may be found in U.S. Pat. No. 5,601,349, to Holt, which discloses a card guide retaining device having a first end extending within a computer chassis and second end extending to without the retainer aperture exterior to the computer chassis.

The prior art electronic device opening cover mechanisms disclosed in the Carney patents and the Holt patent have limited desirability because they are difficult to install and/or they do not provide a cover that substantially fills or seals the opening to minimize the possibility that contaminants will enter into the electronic device.

Accordingly, an improved plug for covering openings of an electronic device is needed.

SUMMARY OF THE INVENTION

It is therefore an advantage of the present invention to provide an improved plug for covering openings of an electronic device.

The above other features and advantages are achieved through a novel plug as herein disclosed. In accordance with one embodiment of the present invention, a plug for covering an opening of an electronic device includes a plurality of elongated ribs positioned to be substantially parallel to each other. Each rib is sized to fully or substantially cover or fill a corresponding plurality of openings in the electronic device. A connecting member is positioned between, and is substantially perpendicular to, two of the ribs. The connecting member is attached to the two ribs such that the relative positions of the ribs and the connecting member correspond to the relative positions of the openings of the electronic device. An angular locking tab is attached to one of the ribs. The tab is positioned to engage one of the openings of the electronic device when the rib having the tab is inserted into the opening.

Optionally and preferably, the plug further includes a first gripping wing attached to a first rib and a second gripping wing attached to a second rib. The wings are positioned to face opposite directions. Each wing is further positioned and includes a recess sized to accept a typical human finger or thumb. Also preferably, each gripping wing is sized and positioned to fully or substantially fill a recess located on the electronic device. The locking tab is preferably comprised of either an elastomeric or plastic material. Also preferably, when inserted into the openings of the electronic device, the plug substantially seals the openings of the electronic device.

In accordance with another embodiment of the present invention, a housing of an electronic device has a plurality of elongated openings, and a plug is sized and shaped to fully or substantially seal the openings when inserted into the openings. The plug includes a plurality of elongated ribs. A connecting member is positioned between and substantially perpendicular to two of the ribs. The connecting member is attached to the two ribs such that the relative positions of the ribs and the connecting member correspond to the relative positions of the openings.

Preferably, the plug further includes a first gripping wing and a second gripping wing positioned on opposite sides of the plug. Each gripping wing is attached to one of the ribs, and each gripping wing is positioned and includes a recess sized to accept a typical human finger or thumb. Also preferably, the housing includes a first recess and a second recess positioned along two of the openings. The gripping wings are sized and positioned to fully or substantially fill each recess in this embodiment. Also preferably, the tab is comprised of an elastomeric or plastic material.

In accordance with an additional embodiment of the present invention, a cover for sealing a plurality of openings of an electronic device includes a plurality of elongated members sized and positioned to fit into or cover a plurality of openings of an electronic device. At least one clip is included. Each clip attaches to and protrudes from one of the elongated members. Each clip is positioned so that the clip is inserted into and engages one of the openings when the cover is inserted into the electronic device. Two gripping wings are also included. Each gripping wing is sized and positioned to accept a human finger or thumb. Each gripping wing is attached to and protrudes from one of the ribs and is positioned so that the gripping wings, in combination, prevent the cover from completely entering the openings when the cover is inserted into the opening. Preferably, each clip is comprised of an elastomeric or plastic material.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract set forth below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The present invention provides a novel apparatus and assembly for sealing or substantially sealing a plurality of openings, such as card ports or disk drive openings, of an electronic device.

Figure 1:
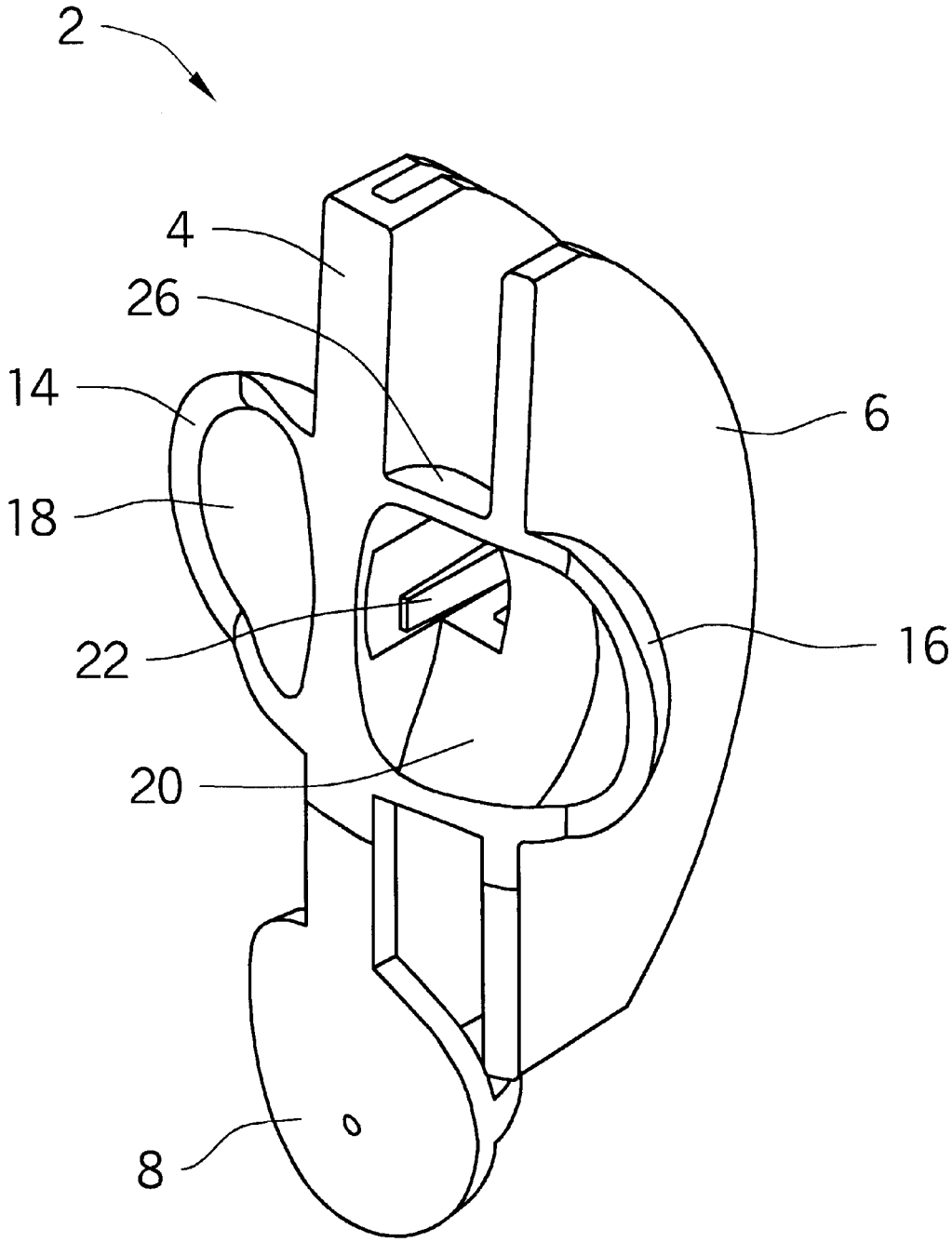
FIG. 1 is a perspective view of the features of various elements of a preferred embodiment of the present inventive plug.

A preferred embodiment of the present inventive plug is illustrated in FIG. 1. As illustrated in FIG. 1, an exemplary embodiment of the present inventive plug 2 includes two elongated ribs 4 and 6. Although FIG. 1 illustrates two elongated members, any number of elongated members may be used so that the number of members corresponds to the number of openings of an electronic device that are desired to be covered. Each elongated member is sized to cover, fill or substantially fill an opening of an electronic device. A connecting member 26 is attached to the elongated members 4 and 6 and is positioned to be substantially perpendicular to the elongated members. The connecting member serves to space the elongated members 4 and 6 into positions corresponding to the positions of openings of the electronic device.

FIG. 1 also illustrates two gripping wings 14 and 16 that project away from the plug 2. Each wing includes a finger recess 18 and 20 that is sized and positioned to accept an ordinary human finger and/or thumb so that an ordinary human may grip the plug to place it into an electronic device or remove the plug from an electronic device. Each wing is attached to one or more of the elongated members. For example, FIG. 1 illustrates that gripping wing 14 may be attached to elongated member 4 and gripping wing 16 may be attached to elongated member 6. Other configurations may be used. Also optionally, connecting member 26 may form part of one or more of the gripping wings, as illustrated in FIG. 1.

Figure 2:
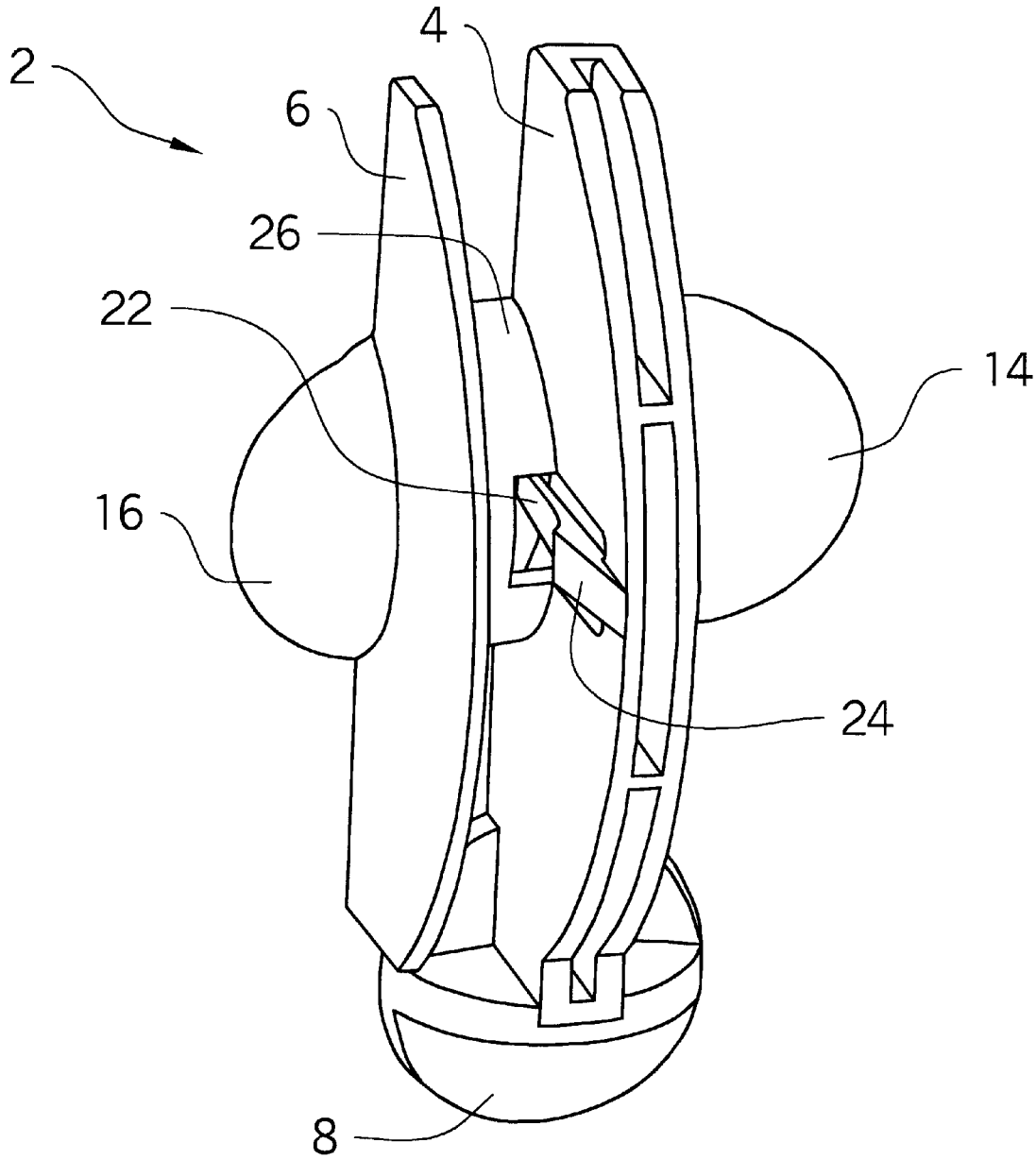
FIG. 2 provides another perspective view of various elements of a preferred embodiment of the present inventive plug.

FIG. 2 provides another perspective view of the plug 2 that was illustrated in FIG. 1. As this view illustrates, the wings 14 and 16 are preferably solid on the underside to facilitate covering the openings when the plug is inserted into the unit. Although FIG. 2 illustrates a curved underside, the wings may actually be made of any shape, including a flat shape, corresponding to the design of the electronic device into which the plug 2 is to be inserted. The wings 14 and 16 help prevent the plug from completely entering the device through the openings when the plug is inserted into the openings. FIG. 2 also illustrates an optional stabilization bar 8 sized and positioned to further stabilize the plug and prevent the plug from moving when the plug is inserted into the openings.

FIG. 2 also illustrates that at least one clip or tab 24 is included. Each tab 24 is attached to an elongated member such as 4 and includes an angular face that allows it to engage with an opening when inserted into the opening. Preferably, each tab is made of an elastomeric material, such as hard rubber, or of a plastic, so that the insertion of the plug into the opening requires a moderate amount of force and the removal of the plug from the opening also requires a moderate amount of force, while still serving to secure the plug 2 to the unit during normal operation. Optionally, a lever such as 22 may be used to provide a means to squeeze the tab 24 inward when removal of the plug 2 from the electronic device is desired.

Figure 3:
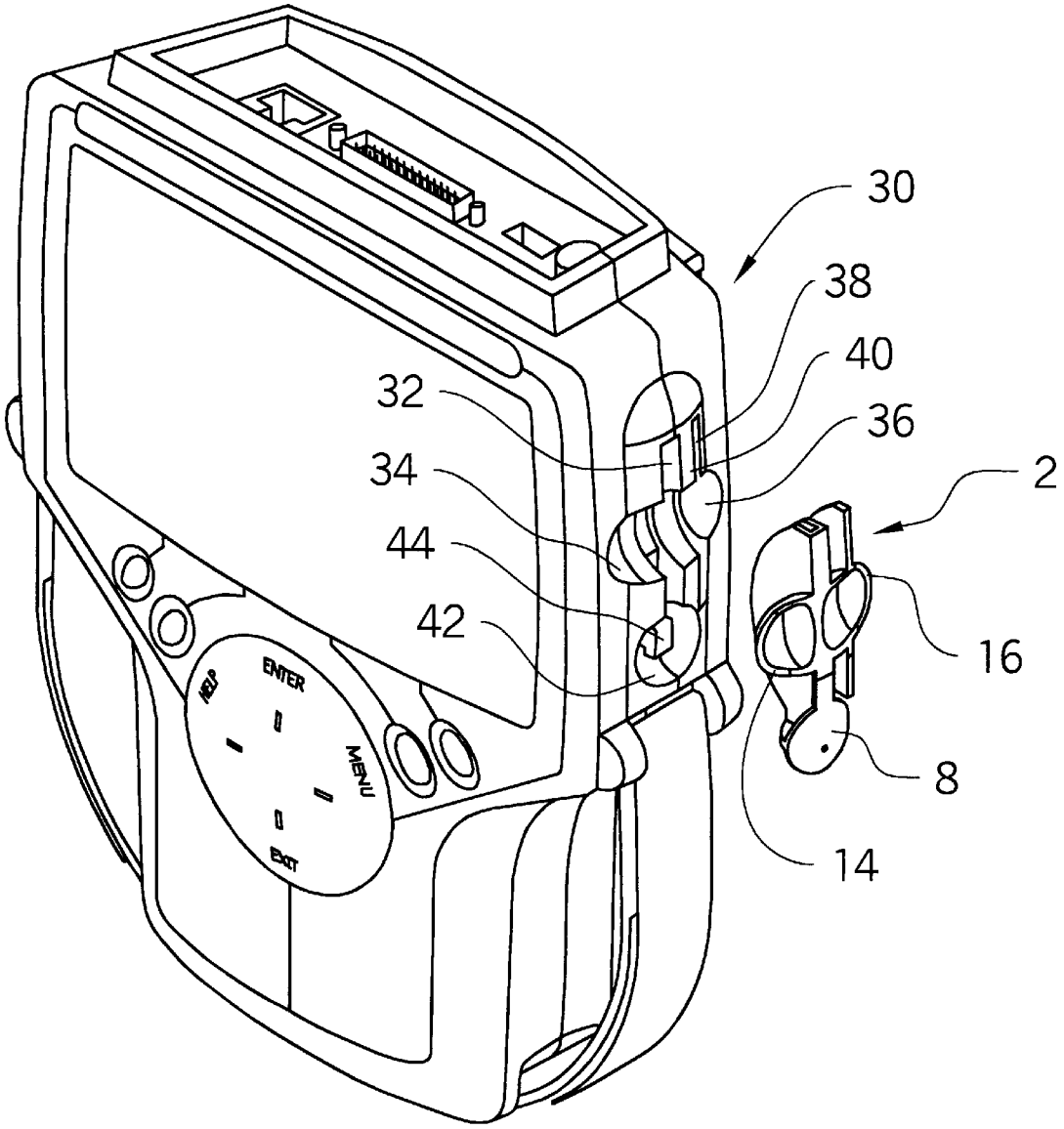
FIG. 3 provides a perspective view of a preferred embodiment of the present inventive plug in combination with an electronic device.

FIG. 3 provides a view of the present inventive plug 2 corresponding to its combination with an exemplary electronic device 30. The electronic device 30 illustrated in FIG. 3 is a hand held vehicle engine analyzer having openings 32 and 38 designed to accept external memory cards. However, the electronic device may be any type of device, such as a personal computer, a laptop computer, a video game device, a pocket PC or palm device, any type of analyzer or diagnostic testing equipment, a remote control, or any other type of device. The electronic device 30 includes a plurality of ports or openings 32 and 38 that allow for insertion of materials into the device. Such ports or openings 32 and 38 may be, for example, a memory card port, a modem card port, a disk drive opening, or any type of opening, or port that may be found on an electronic device. Although FIG. 3 illustrates an electronic device having two openings, any number of openings may be used.

The device 30 illustrated in FIG. 3 also includes recessed areas 34 and 36 located along the openings, and the wings 14 and 16 of the plug are sized and positioned to fill the recessed areas. The recessed areas, however, are in fact optional, and the present invention may be designed to such that the wings 14 and 16 are flat and merely are placed on top of the housing of the electronic device while the elongated members such as 4 and 6 are inserted into the openings. In FIG. 3 the elongated members 4 and 6 are sized and positioned such that when they are inserted into the openings the clips or tabs illustrated in FIG. 2 also enter at least one of the openings and secure the plug to the electronic device. The elongated members 4 and 6 are sized to substantially fill the openings 32 and 38 of the electronic device, and optional stabilization bar 8 may also fit over or within one or more of the openings, such that the various elements of the plug 2 fully or substantially fill all portions of openings 32 and 38, thus creating a substantial seal and helping to prevent contaminants from entering the device.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A plug for covering a plurality of openings of an electronic device, comprising:

a plurality of elongated members positioned to be substantially parallel to each other and sized to substantially cover or fill an equal plurality of openings of an electronic device;

a connecting member positioned between two of the elongated members and secured to said two elongated members; and at least one means for securing at least one of the elongated members when said members are inserted into the electronic device.

2. The plug of claim 1 further comprising a first gripping wing attached to a first rib and a second gripping wing attached to a second rib, the wings positioned to face opposite directions, each gripping wing further positioned and including a recess sized to accept a typical human finger or thumb.

3. The plug of claim 2 wherein the first gripping wing is sized and positioned to fully or substantially fill a first recess located on the electronic device, and the second gripping wing is sized and positioned to fully or substantially fill a second recess located on the electronic device.

4. The plug of claim 1 wherein the locking tab is comprised of an elastomeric material.

5. The plug of claim 1 wherein the locking tab is comprised of a plastic material.

6. The plug of claim 1 wherein the plug, when inserted into the openings of the electronic device, substantially seals the openings of the electronic device.

7. In combination, a housing of an electronic device having a plurality of elongated openings and a plug sized and shaped to fully or substantially seal the openings when inserted into the openings, wherein the plug comprises:

a plurality of elongated ribs;

a connecting member positioned between and substantially perpendicular to two of the ribs and attached to the two ribs; and an angular locking tab attached to one of the ribs, the tab positioned to engage one of the openings when the rib having the tab is inserted into the opening, wherein the relative positions of the ribs and the connecting member correspond to the relative positions of the openings.

8. The combination of claim 7 wherein the plug further comprises a first gripping wing and a second gripping wing positioned on opposite sides of the plug, each gripping wing attached to one of the ribs, and each gripping wing positioned and including a recess sized to accept a typical human finger or thumb.

9. The combination of claim 8 wherein the housing further includes a first recess and a second recess positioned along two of the openings, and the gripping wings are sized and positioned to fully or substantially fill the first recess and the second recesses.

10. The combination of claim 7 wherein the tab is comprised of an elastomeric or plastic material.

11. A cover for sealing a plurality of openings of an electronic device, comprising:

a plurality of elongated members sized and positioned to fit into or cover a plurality of openings of an electronic device;

at least one clip, each clip attached to and protruding from one of the elongated members, each clip positioned so that the clip is inserted into and engages one of the openings when the cover is inserted into the electronic device; and two gripping wings, each gripping wing sized and positioned to accept a human finger or thumb, each gripping wing attached to and protruding from one of the ribs, each gripping wing positioned so that the gripping wings prevent the cover from completely entering the openings when the cover is inserted into the opening.

12. The cover of claim 11 wherein each clip is comprised of an elastomeric or plastic material.

13. The cover of claim 11 wherein the cover, when engaged with the electronic device, substantially seals the opening of the electronic device.

14. A plug for covering a plurality of openings of an electronic device, comprising:

a plurality of elongated members positioned to be substantially parallel to each other and sized to substantially cover or fill an equal plurality of openings of an electronic device;

a connecting member positioned between two of the elongated members and secured to said two elongated members; and at least one means for securing at least one of the elongated members to the electronic device.

15. The plug of claim 14 further comprising a means for gripping the plug, the means for gripping sized to accept a typical human finger or thumb.

16. The plug of claim 15 wherein the means for gripping is sized and positioned to substantially fill at least one recess located on the electronic device.

17. The plug of claim 14 wherein each means for securing is comprised of an elastomeric material.

18. The plug of claim 14 wherein each means for securing is comprised of a plastic material.

19. The plug of claim 14 wherein the plug, when inserted into the plurality of openings of the electronic device, substantially seals the plurality of openings of the electronic device.

20. The plug of claim 14 wherein the means for securing permits the plug to be inserted into and withdrawn from the device with moderate force.

* * * * *